US011408332B2

(12) United States Patent
Pekar et al.

(10) Patent No.: US 11,408,332 B2
(45) Date of Patent: Aug. 9, 2022

(54) ENGINE AND EMISSIONS CONTROL SYSTEM

(71) Applicant: Garrett Transportation I Inc., Torrance, CA (US)

(72) Inventors: Jaroslav Pekar, Pacov (CZ); Paul Dickinson, Bristol (GB)

(73) Assignee: Garrett Transportation I, Inc., Torrance, CA (US)

( * ) Notice: Subject to any disclaimer, the term of this patent is extended or adjusted under 35 U.S.C. 154(b) by 0 days.

(21) Appl. No.: 17/078,844

(22) Filed: Oct. 23, 2020

(65) Prior Publication Data

US 2022/0127996 A1 Apr. 28, 2022

(51) Int. Cl.

| | |
|---|---|
| ***F02B 37/18*** | (2006.01) |
| ***F02M 26/05*** | (2016.01) |
| ***F02D 41/00*** | (2006.01) |
| ***F02M 26/06*** | (2016.01) |
| ***F02B 37/24*** | (2006.01) |

(Continued)

(52) U.S. Cl.

CPC ..... *F02B 37/186* (2013.01); *F02B 37/24* (2013.01); *F02B 39/10* (2013.01); *F02D 9/04* (2013.01); *F02D 41/0007* (2013.01); *F02D 41/0047* (2013.01); *F02D 41/26* (2013.01); *F02M 26/05* (2016.02); *F02M 26/06* (2016.02)

(58) Field of Classification Search

CPC ..... F02M 26/05; F02M 26/06; F02B 37/186; F02B 37/24; F02B 39/10; F02D 9/04; F02D 41/0007; F02D 41/0047; F02D 41/26; F01N 3/00; F01N 3/206; F01N 3/266; G05B 13/02

USPC ..... 60/605.2; 700/44–45; 701/108

See application file for complete search history.

(56) References Cited

U.S. PATENT DOCUMENTS 5,519,605 A 5/1996 Cawfield
5,642,722 A * 7/1997 Schumacher ..... F02D 41/047 701/103

(Continued)

OTHER PUBLICATIONS

K. Walker, B. Samadi, M. Huang, J. Gerhard, K. Butts and I. Kolmanovsky, "Design environment for Nonlinear Model Predictive Control," tech, rep., SAE Technical Paper, 2016.*

(Continued)

*Primary Examiner* — Shafiq Mian

(74) *Attorney, Agent, or Firm* — Seager, Tufte & Wickhem, LLP

(57) ABSTRACT

A system for coordinated control of an engine and associated components over various engine-modes of operation. The system may include an engine, one or more components controllable to adjust operation of the diesel engine, and a system controller. The system controller may be connected to the engine and the one or more components. The system controller may include a supervisory controller and one or more component controllers. The supervisory controller may receive system control variable set points and coordinate component control variable set points for the components to achieve the system control variable set points. The component controllers may control operation of the components to achieve the control variable set points for the components by setting manipulated variable set points for the components based on the component control variable set points and a model based non-linear dynamic inversion.

20 Claims, 7 Drawing Sheets

(51) Int. Cl.

| | |
|---|---|
| ***F02D 9/04*** | (2006.01) |
| ***F02D 41/26*** | (2006.01) |
| ***F02B 39/10*** | (2006.01) |

(56) References Cited

U.S. PATENT DOCUMENTS

| | | | | |
|---|---|---|---|---|
| 5,819,714 | A * | 10/1998 | Bush | F02D 41/047 701/104 |
| 6,882,889 | B2 * | 4/2005 | Fuller | G05B 13/042 700/45 |
| 7,861,518 | B2 * | 1/2011 | Federle | F01N 3/208 60/286 |
| 7,881,830 | B2 | 2/2011 | Yasui et al. | |
| 8,145,329 | B2 * | 3/2012 | Pekar | G05B 13/048 700/45 |
| 8,250,857 | B2 * | 8/2012 | Driscoll | F01N 3/208 60/286 |
| 8,511,065 | B2 * | 8/2013 | Greszler | F02D 41/0065 60/274 |
| 8,788,450 | B2 * | 7/2014 | Ulyanov | G05B 13/0295 706/62 |
| 8,899,018 | B2 * | 12/2014 | Frazier | F02D 41/005 60/285 |
| 8,899,108 | B2 * | 12/2014 | Speldrich | F17D 1/00 73/204.21 |
| 9,081,378 | B2 * | 7/2015 | Lu | G05B 13/04 |
| 9,296,474 | B1 * | 3/2016 | Nguyen | G05B 13/048 |
| 9,562,484 | B2 | 2/2017 | Huang et al. | |
| 9,677,493 | B2 | 6/2017 | Stewart et al. | |
| 9,765,703 | B2 | 9/2017 | Whitney et al. | |
| 9,938,908 | B2 | 4/2018 | Li et al. | |
| 10,309,281 | B2 * | 6/2019 | Stewart | F02D 41/266 |
| 10,422,290 | B1 * | 9/2019 | Liao-McPherson | F02B 37/24 |
| 2011/0264353 | A1 | 10/2011 | Atkinson et al. | |

OTHER PUBLICATIONS

L. Grune and J. Pannek, Nonlinear Model Predictive Control, pp. 43-66 Springer, Apr. 2011.*

M. Huang, H. Nakada, K. Butts, and 1. Kolmanovsky, Nonlinear model predictive control of a diesel engine air path: A comparison of constraint handling and computations strategies, IFAC—PapersOnLine, vol. 23, pp. 372-379,2015.*

K. Harder, M. Buchholz, J. Niemeyer, J. Remele, and K. Graichen, "A real-time nonlinear mpc scheme with emission x>nstraints for heavy-duty diesel engines," in American Control Conference (ACC), 2017, pp. 240-245, IEEE, 2017.*

K. Harder, M. Bucholz, J. Niemeyer, J. Remele and K. Graichen, "Nonlinear mpc with emission control for a real-world off-highway diesel engine," in Advanced Intelligent Mechatronics (AIM), 2017 IEEE International Conference on, pp. 1768-1773, IEEE, 2017.*

Q. Zhu, S. Onori and R. Prucka, "Nonlinear economic model predictive control for si engines based on sequential quadratic programming," in American Control Conference (ACC), 2016, pp. 1802-1807, IEEE, 2016.*

Extended European Search Report for EP Application No. 21202461.6 dated Mar. 17, 2022, 8 pages.

* cited by examiner

ENGINE AND EMISSIONS CONTROL SYSTEM

BACKGROUND

The present disclosure pertains to operating an engine so as to mitigate environmentally harmful emissions, and particularly an approach to operate engine components in a coordinated manner to mitigate environmentally harmful emissions.

SUMMARY

The disclosure reveals an engine system including a diesel engine, one or more components controllable to adjust operation of the diesel engine, and a system controller connected to the diesel engine and the one or more components controllable to affect and/or effect operation of the diesel engine. The system controller may include a supervisory controller and one or more component controllers. The supervisory controller may be configured to receive system control variable set points and coordinate component control variable set points for the one or more components to achieve the system control variable set points. Each of the one or more component controllers may be configured to control operation of the one or more components to achieve the control variable set points for the one or more components by setting manipulated variable set points for the one or more components based on the component control variable set points and a model based non-linear dynamic inversion.

DESCRIPTION

Figure 1:
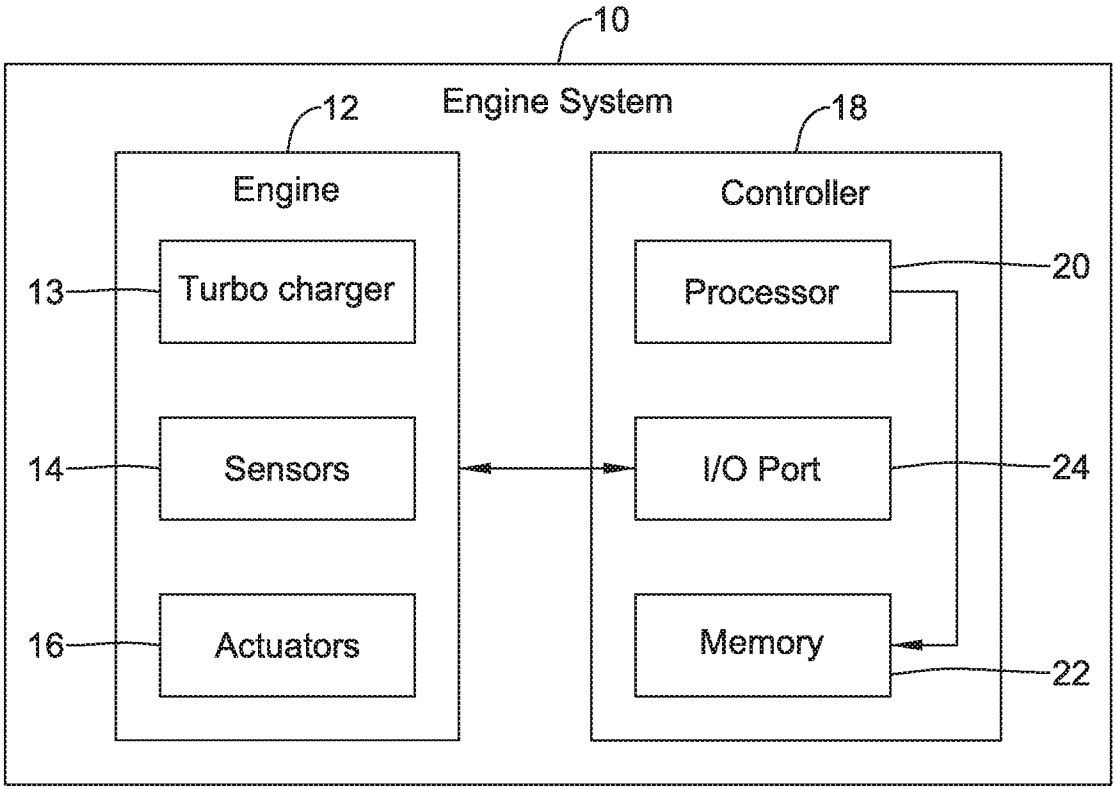
FIG. 1 is a schematic diagram of an illustrative engine system.

Modern engines (e.g., diesel engines and/or other suitable engines) may be complex systems with many components. In some cases, the complexity of diesel engines may be driven by legislation (e.g., legislation intended to reduce toxic pollutants and/or to improve fuel economy). Key components of an engine system for achieving challenging goals set by legislation and/or other goals for diesel engines may include, but are not limited to, advanced fuel system components, air inductions systems (e.g., air induction systems including one or more of conventional turbochargers, electrified turbochargers, wastegate (WG) turbocharger, variable geometry turbochargers (VGT), conventional compressors, electrified compressors, and so forth), advanced exhaust gas recirculation (e.g., high pressure and/or low pressure recirculation routes), selective catalytic reduction (SCR) systems, diesel particulate filter (DPF) systems, NOx adsorber systems (e.g., lean NOx Trap (LNT) systems, and so on), other suitable aftertreatment systems, and/or other suitable components.

To achieve target goals and/or requirements, precise control systems may be employed to ensure satisfaction of all requirements given by legislation, market requests, technology constraints, and so on. As there may be many actuators and/or sensors utilized in an engine system, different subsystems of the engine system may interact with one another, and many engine modes of engine system operation to achieve the goals and/or requirements, design, implementation, calibration, and certification of an engine system may be a challenging process.

In view of the above, increased use of electrified components and increases in computing, communication, and connectivity of engine systems allow for new opportunities of engine optimization, implementation, and calibration of control systems. That is, coordinated control of the engine components across the various engine modes is desired. The disclosed concepts streamline control design of engine systems, reduce development costs for engine systems, facilitate modularity of engine systems to facilitate use of new technologies (e.g., electric turbochargers or compressors, connectivity, and so forth), and/or provide additional benefits.

Such concepts may include a modular control system (e.g., a system controller) architecture. In some cases, the modular control system architecture may have two layers. For example, the modular control system may have a low level layer and a high level layer. The high level layer may utilize a model of the overall engine system and utilize an optimization based control approach (e.g., a model predictive control (MPC) approach and/or other suitable control approach). The low level layer may utilize a model or models of the subcomponents of the engine systems and may utilize a suitable control approach. Although the modular control system may be implemented on one or more control units (e.g., on two or more subsystem component control units), the modular control system may be implemented entirely or at least partially on an engine control unit (ECU).

The models in the high level layer and the low level layer may be developed and/or calibrated using various configuration and calibration tools. In one example, the GARRETT™ Virtual Sensor Toolbox (VST) and GARRETT™ Nonlinear MPC Toolbox may be utilized for the development and calibration of the models in the high level layer and/or the low level layer. Additional and/or alternative tools are contemplated for developing and/or calibrating the models of the system controller.

The high level layer may include a high level controller, which may be considered a supervisory controller, but this is not required. The high level controller may be configured to provide set points for control variables of engine system components. Although other suitable supervisory controllers are contemplated, example supervisory controllers are discussed in U.S. patent application Ser. No. 13/236,217 filed on Sep. 19, 2011, now U.S. Pat. No. 9,677,493, titled "A COORDINATED ENGINE AND EMISSIONS CONTROL SYSTEM", which is hereby incorporated by reference for all purposes.

The high level controller may be configured to ensure that high level targets (e.g., high level control variable set points) are achieved for an engine. For example, the high level controllers may be configured to ensure a set fuel economy, a set emissions level, an engine health metric, and/or other high level target for an engine is achieved. In some cases, the high level controller may be implemented using an optimization based approach utilizing preview information (e.g., information related to disturbance variables on the horizon). The high level controller may be implemented with an MPC approach, but this is not required.

In one example, the high level controller may be based on a non-linear MPC approach and the objective may be to optimize the engine in terms of various control variables. When preview information (e.g., information regarding disturbance variables) is available, such information may be utilized by the high level controller to further improve operation of the engine system to achieve set points for engine system control variables. Further, the high level controller may take into account a health status of various subsystems (e.g., a battery in an electric powertrain, EGR valve closure capability, and so on) of the engine system and adjust the control automatically to ensure a vehicle including the engine system meets the engine system control variable set points.

The low level layer may include a plurality of controllers, each configured to control an actuator or a set of actuators of a component of the engine system. The controllers of the low level layer (e.g., low level controllers) may be considered compensators and may implement a model based non-linear dynamic inversion approach configured to provide set points for manipulated variables of the actuators or groups of actuators. Objectives of the low level controllers may be to stabilize the engine of the engine system, reject fast disturbances, and significantly reduce nonlinear behavior of the engine air path under some or all engine modes (e.g., during LNT or DPF regeneration, engine heating, and so on)

In some cases, one or more of the high level and low level controllers may be multivariable controllers. Multivariable controllers may facilitate providing actuator set points (e.g., manipulated variable set points) for systems including, but not limited to, VGT systems, HP EGR systems, and/or other suitable engine subsystems. However, other engine subsystems that may be single-input, single-output systems that may not require a multivariable controller. Example engine subsystems may be single-input, single-output systems may be low pressure exhaust gas recirculation (LP EGR) systems, throttle valve systems, and/or other suitable systems.

In one example of a low level controller, the low level controller may be based on a subsystem-specific implementation of a non-linear dynamic inversion control approach. For example, in an engine system including four actuators on an airside of a diesel engine (e.g., a LP EGR valve, a HP EGR valve, a VGT or WG and/or electric motor if an electric turbocharger is used, and a throttle valve), each actuator may have its own dedicated low level controller having a subsystem-specific implementation of a model based non-linear dynamic inversion control approach configured to use outputs from the high level controller to determine set points for an associated actuator (e.g., a set point for a manipulated variable). In some cases, the LP EGR valve and the throttle valve may be single-input, single-output actuators and the respectively associated low level controllers may be implemented using model based non-linear dynamic inversion control approaches. Further, the VGT or WG (and possibly an electric motor of an electric turbocharger) and HP EGR may have interactions via engine back pressure and therefore, may be controlled using multivariable model based non-linear dynamic inversion approaches.

As used herein, a control variable may be a variable for a system or subsystem to achieve. Example control variables include, but are not limited to, a mass air-flow output of an engine system, a NOx output of an engine system, particulate matter (PM) output of an engine system, oxygen concentration or burned gas fraction (BGF) at an intake manifold, oxygen concentration or BGF at a compressor, pressure difference across the air throttle valve, pressure at a compressor outlet, pressure at an intake manifold, EGR mass flow rate, EGR ratio (e.g., ratio of HP EGR to LP EGR, and the like. A manipulated variable may be a variable that may be varied to achieve a set point for the control variable. Example manipulated variables include, but are not limited to, a throttle valve position or area, an HP EGR valve position or area, an LP EGR valve position or area, a set point of a VGT or a wastegate or an electric motor of an electric turbocharger, exhaust flap position, intake throttle valve position or area, camshaft phasing or lift, and so forth. A disturbance variable may be a variable outside of a control system's control that may have an effect on achieving a set point for a control variable using a set point for a manipulated variable. Example disturbance variables may include, but are not limited to, road topology information (e.g., a grade of a road, a curvature of a road, and so forth) information about traffic flow, traffic lights, vehicle speed limits, and the like.

Turning to the Figures, FIG. 1 depicts an illustrative engine system 10. The engine system 10 may include an engine 12 (e.g., a diesel engine, a gasoline engine, and/or other suitable engine) and a controller 18 in communication the engine 12. In some cases, the engine system 10 may include one or more additional components, including, but not limited to, a powertrain that may incorporate the engine, a powertrain controller, an exhaust gas aftertreatment system/mechanism, a drive train, a vehicle, and/or other suitable component. Any reference herein to an engine, powertrain, or aftertreatment system may be regarded as a reference to any other or all of these components. Example components of the engine system 10 may include, but are not limited to, EGR components, HP EGR components, LP EGR components, air throttle, exhaust flap, intake throttle, electric-turbocharger, VGT, wastegate (WG) turbocharger, start of injection (SOI) component, camshafts, and so forth.

The engine 12 may include one or more turbochargers 13 (e.g., standard turbochargers, electric turbochargers, VGTs, wastegate turbochargers, and so forth), one or more sensors 14, one or more actuators 16, and/or one or more additional or alternative components. Examples of engine actuators include, but are not limited to, actuators of a turbocharger WG, VGT actuator, electric motor, EGR system actuator, HP EGR valve, a LP EGR valve, a SOI actuator, a throttle valve (TV), camshafts, and so on. The sensors 14 (e.g., physical sensors and/or virtual sensors) may be configured to sense positions of actuators and/or values of other engine variables or parameters and then communicate those values to the controller 18. Example sensors include, but are not limited to, air flow meter sensors, pressure sensors, temperature sensors, lambda sensors, intake manifold pressure sensors, temperature sensors at intercooler outlets, LNT inlet temperature sensors, DPF inlet temperature sensors, SCR inlet temperature sensors, lambda sensors at the LNT inlet, lambda sensors at the DPF outlet, gas analyzers for oxygen and carbon oxides, and so on.

The controller 18 may be, be part of, and/or include an engine control module (ECM) or engine control unit (ECU) with a control system algorithm therein. The controller 18 may include one or more components having one or more processors 20, memory 22, one or more input/output ports 24, and/or one or more other suitable components. The memory 22 may include one or more control system algorithms and/or other algorithms and the processor 20 may execute instructions (e.g., software code or other instructions) related to the algorithm(s) in the memory 22. The memory 22 may include instructions for execution by a processor to effect one or more virtual sensors using data from physical sensors. The memory 22 may be any suitable memory type and may be considered a computer readable medium configured to store instructions thereon in a non-transitory state. The I/O port 24 may send and/or receive information and/or control signals to and/or from the engine 12. In one example, the I/O port 24 may receive values from the sensors 14 and/or send control signals from the processor 20 to the engine 12.

Figure 2:
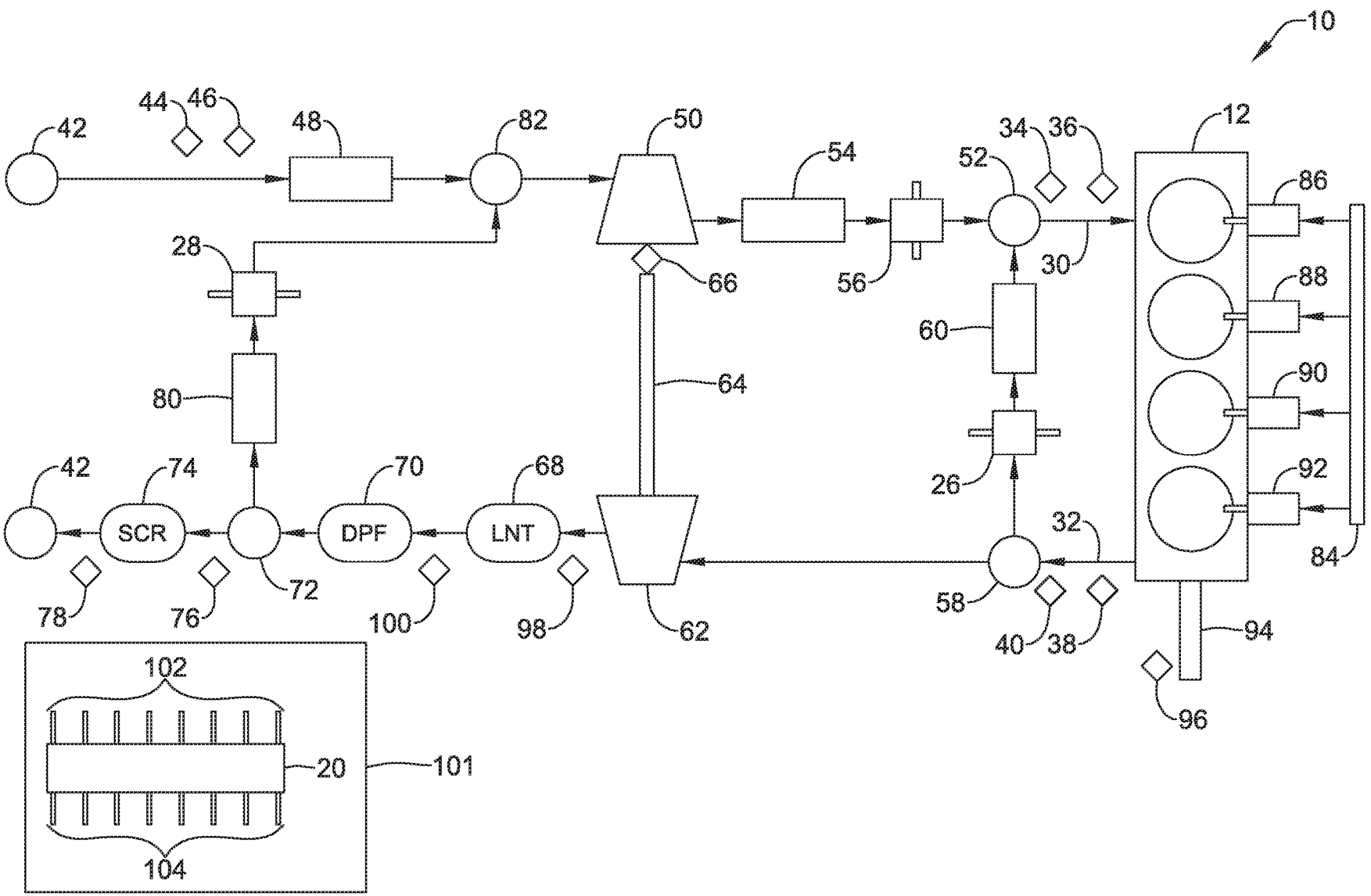
FIG. 2 is a schematic diagram of an illustrative turbocharged diesel engine system.

FIG. 2 is a diagram of an illustrative engine system 10 having a turbocharged diesel engine. A system of the gas flows in the turbocharged diesel engine with a high pressure (HP) EGR valve 26 and a LP EGR valve 28 is shown in the diagram. The diagram shows a schematic layout of the engine 12 (e.g., an internal combustion engine) and its peripheral components related to air and fuel supply (e.g., the air path system).

The engine 12 may have an intake manifold 30 and an exhaust duct or manifold 32. Intake pressure and intake temperature may be detected with a pressure sensor 34 and a temperature sensor 36, respectively. Exhaust pressure and temperature may be detected with a pressure sensor 38 and a temperature sensor 40, respectively. However, in some cases, production engines may not necessarily be equipped with the pressure sensor 38 and the temperature sensor 40 due to a difficulty with sensors placed on the exhaust side. When a pressure sensor, temperature sensor, and/or other suitable sensor is not included in an engine system and the values from the omitted sensors are desired for control of the engine system, models or observers (e.g., virtual sensors) that may provide calculated values of the parameters at the locations of the missing sensors based on other sensed and/or virtual parameter values may be utilized to by an engine controller.

In operation, air may come in from an ambient environment 42 at an input pressure and input temperature as indicated by sensors 44 and 46, respectively, positioned before an air filter 48. The filtered air may be mixed with LP EGR gas (as discussed below). The air may be compressed by a compressor 50 and flow to a mixing point or plenum 52. Because air becomes hotter when compressed, an engine charge air cooler (CAC) 54 may be used to reduce compressed air temperature. A throttle valve 56 may be placed downstream of the compressor 50 in order to control the pressure in the intake manifold 30.

Some exhaust gas may be fed from exhaust manifold 32 through a splitter 58 and through the HP EGR valve 26 and out of the valve through a cooler 60 to the mixing point or plenum 52 where charged air from the compressor 50 and exhaust gas from the HP EGR valve 26 meet. The HP EGR valve 26 may control an amount of HP EGR gas that passes to the plenum 52. Exhaust gas at an input of the HP EGR valve 26 may have a pressure and a temperature. Exhaust gas that is not directed toward HP EGR valve 26 may go to drive a turbine 62 which turns a shaft 64 at N rotations per unit of time or a rate of angular movement omega (w) as indicated by a sensor 66. The shaft 64 may drive compressor 50 that outputs the compressed air.

The exhaust gas may pass through a number of after-treatment devices removing harmful compounds. Firstly, the exhaust gas may pass a lean NOx trap (LNT) system 68 to reduce an amount of oxides of nitrogen (e.g., NO and $NO_2$) that are in the exhaust gas. When the NOx storage capacity of LNT system 68 exceeds a saturation level, the LNT system 68 may need a rich state of the exhaust gas to convert stored NOx into $N_2$. Such a rich state may be realized by the change of combustion and air path characteristics.

Next, the exhaust gas may pass through the diesel particulate filter (DPF) system 70 to trap soot particles which may be later burned using just the exhaust heat (passive regeneration) or using an extra diesel fuel injector located at the filter inlet (active regeneration). Like the LNT system 68, after the accumulated soot is higher than the certain limit, the oxidation of soot in the DPF system 70 may be required to prevent the exhaust gas flow from being blocked. To burn soot in the DPF system 70, the exhaust gas temperature may be increased sufficiently to oxidize the soot particles with reasonable oxygen content.

Then some of the exhaust gas may pass through a splitter 72 and may be treated in a selective catalyst reduction (SCR) system 74 where most of the nitrogen oxides may be converted into harmless diatomic nitrogen using urea injected by a dosing system. In order to control the amount of urea used, the SCR system 74 may be equipped with an inlet NOx sensor 76 and an outlet NOx sensor 78, which may also provide additional information on the oxygen concentration in the exhaust gas. The SCR system 74 may use ammonia created from the urea as a reducing agent to reduce the nitrogen oxides. The excess ammonia which may pass unreacted from the SCR system 74 as a result of urea overdosing may be removed using an ammonia slip catalyst (AMOX). In addition to or as an alternative to the after-treatment systems discussed above, some diesel engines may also use a diesel oxidation catalyst (DOC, not shown).

After the DPF system 70 and before the SCR system 74, some of the exhaust gas may pass through the splitter 72 through a cooler 80 and then through the LP EGR valve 28 and out of the LP EGR valve 28 to the mixing point or plenum 82, where filtered air from the air filter 48 and exhaust gas from the LP EGR valve 28 meet. The LP EGR valve 28 may control an amount of LP EGR gas that passes to the plenum 82. Exhaust gas at an input of the LP EGR valve 28 may have a pressure and a temperature. Exhaust gas that is not directed toward LP EGR valve 28 may be exhausted to the ambient 42 through the SCR system 74.

The cylinders of the engine 12 may be a recipient of fuel via a line or tube 84 to fuel injectors 86, 88, 90, 92. The fuel from the injectors 86, 88, 90, 92 may mix with the air and EGR gas in the cylinders of the engine 12 for combustion to move the pistons and turn the crankshaft for a mechanical rotational output at a shaft 94. Engine speed may be measured by a sensor 96 at the shaft 94. Other approaches may be used for measuring engine speed.

A lambda or oxygen sensor 98 may be situated in an exhaust duct where an exhaust stream may flow such as, for example, after the turbine 62, after the LNT system 68 as sensor 100, after the DPF system 70 as the sensor 76, after the SCR system 74 as the sensor 78, and/or there may be several lambda sensors at several locations, simultaneously. The lambda sensor may be combined with a NOx sensor.

Some acronyms that may be used relative to engine aftertreatment technology may incorporate SCR (selective catalytic reduction), SCRF (SCR on filter), DPF (diesel particulate filter), DOC (diesel oxidation catalyst), LNT (lean NOx trap), and PNA (passive NOx adsorber).

The exhaust or exhaust stream, as used herein, may mean turbine-out, DOC-out, DPF-out, SCR-in, SCR-out, and/or even tailpipe-out. Though the oxygen content does not necessarily change significantly in the exhaust stream, it may be affected by some of the oxidations in the aftertreatment devices. Exhaust configurations may consist of, for example, turbine-DOC-DPF-SCR and turbine-PNA/LNT/DOC+SCRF+SCR. The lambda or oxygen sensor(s) may be situated virtually anywhere.

The processor 20, which may be implemented in an ECU as depicted in FIG. 2, may receive inputs 102 from one or more sensors of the sensors 34, 36, 38, 44, 46, 66, 76, 78, 96, 98, 100 and/or other suitable sensors, at an input port of the I/O port(s) 24 via wire or wireless connections. The outputs 104 from the processor 20 may be used for controlling the HP EGR valve 26, the LP EGR valve 28, the throttle valve 56, and/or other suitable actuators of the engine system 10. Other components, including, but not limited to, the coolers 60, 80, the vanes of the VGT 62 or turbine WG, the injectors 86, 88, 90, 92, an exhaust flap, and so forth, may be controlled by the output or outputs 104 from processor 20. Block 101 may encompass processor 20 having the input or inputs 102 and the output or outputs 104.

Controlled target values of engine air path systems may be known, as they may have been developed for fuel economy and exhaust gas of the engine. Diesel engines typically utilize pressure control and illustrative controlled variables of the engine system 10 that may include air mass flow rate, oxygen concentration or BGF in the intake manifold, oxygen concentration or BGF at the compressor inlet, pressure difference across the air throttle valve, pressure after the compressor, pressure in the intake manifold, EGR mass flow, or EGR ratio. Target set points of the air mass flow rate or pressure may be affected by one or both of a vane position control of a variable turbocharger and an EGR flow rate. The intake manifold oxygen concentration or BGF may depend on the air mass flow rate, HP EGR flow rate, and LP EGR flow rate. The oxygen concentration or BGF at the compressor inlet may be controlled by the air mass flow rate and LP EGR flow rate. In both the HP EGR and LP EGR route, the EGR flow rate may be regulated by the corresponding EGR valve (e.g., the HP EGR valve 26 and the LP EGR valve 28) and is affected by the pressures and temperatures at its inlet and outlet. However, the pressures and temperatures also change with the gas flows. Therefore, multi target set points of the air path system may be closely related and are not easy to control. The pressure difference across the air throttle valve may be relatively easy to control because it may be adjusted solely by the position of the throttle valve. The manipulated variables of this air path system are the position of the HP EGR valve 26, the position of the LP EGR valve 28, the turbine vane position of the variable geometry turbocharger, and the position of the air throttle valve 56. Each actuator may have a position learning function to avoid a position offset, but this is not required.

Various coordinated operating modes of the engine may be utilized to ensure good fuel economy, emission regulation, and combustion stability. Typical operation modes of the air path system of the engine system 10 may include HP EGR mode, Double EGR mode (e.g., where HP EGR and LP EGR may be utilized), LNT Rich mode, and DPF regeneration mode. Other operation modes are contemplated.

In the HP EGR mode, which may be utilized in cold or startup conditions among other conditions, EGR gas flow goes only through the HP EGR route. This is because components can be damaged due to water vapor condensation by cooler LP EGR gas and excessively low temperature EGR gas may cause combustion instability in a cold condition. After the engine is sufficiently warmed up, the LP EGR is activated to effectively ensure sufficient EGR flow rate and improved emissions. At this dual EGR operation mode, HP EGR can also be activated at the same time. When the NOx storage capacity of LNT system 68 exceeds a saturation level, the LNT system 68 may need a rich state of the exhaust gas to convert stored NOx into $N_2$. Such a rich state may be realized by the change of combustion characteristics. Soot emission may be accumulated in the DPF system 70. Like the LNT system 68, after the accumulated soot is higher than the certain limit, the oxidation of soot in the DPF system 70 may be required to prevent the exhaust gas flow from being blocked. To burn soot in the DPF system 70, the exhaust gas temperature may be increased sufficiently to oxidize the soot particles with reasonable oxygen content. In the LNT rich mode, post main injection(s) promote partial oxidation in the cylinder so that the oxygen concentration of the exhaust gas is to be hot and/or rich. Those post injections raise the exhaust gas temperature in the DPF regeneration mode. However, these combustion characteristic changes are not possible only with fuel injection. These profiles of heat release rate are highly dependent on the control parameters of air path such as an air mass flow rate, oxygen concentrations as well as on fuel injection patterns. Therefore, the proper manipulated variable target set points may be different for each operation mode of the engine system 10 to meet desired control variable set points. As the proper manipulated variable target set points needed to achieve desired control variable set point for each engine operation mode, there may be many controller set point maps needed.

Figure 3:
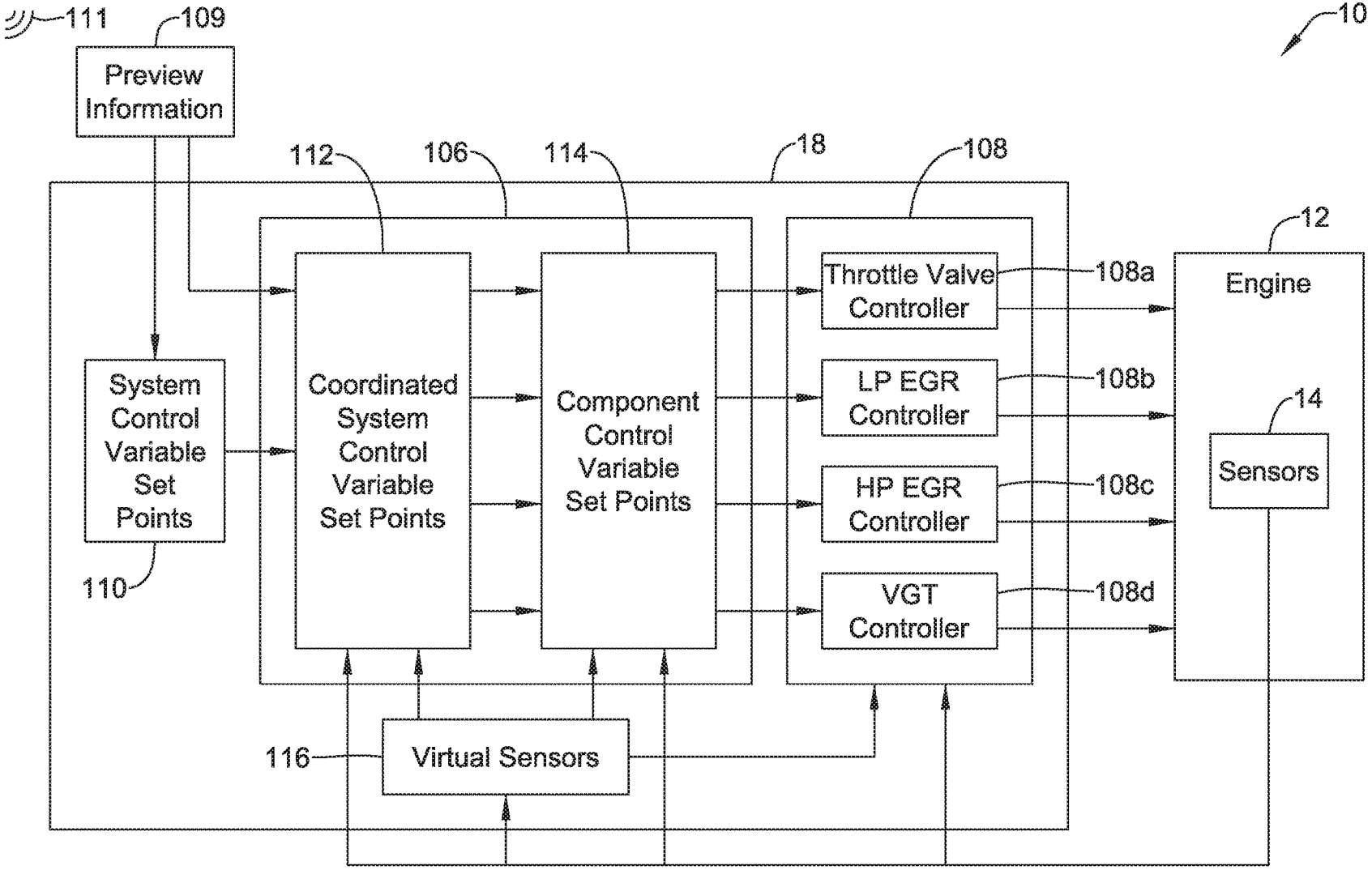
FIG. 3 is a schematic diagram of an illustrative controller configuration for an air path of an engine system.

FIG. 3 depicts a schematic diagram of an illustrative control configuration for the air path of the engine system 10 that provides coordinated control of the engine component across all engine-modes. The control configuration may include the controller 18 (e.g., a system controller connected to the engine 12). In some cases, the controller 18 may include a supervisory controller 106 and one or more component controllers 108. Example component controllers include, but are not limited to, a throttle valve controller 108*a*, an LP EGR controller 108*b*, an HP EGR controller 108*c*, and a VGT controller 108*d*. Any suitable number of component controllers may be utilized and one or more component controllers may be added and/or removed overtime as engine components are added, removed, and/or updated.

The supervisory controller 106 may be configured to receive system control variable set points 110 and determine, based on a model of the engine system 10, coordinate component control variable set points 114 for one or more components (e.g., a HP EGR system having the HP EGR valve 26, a LP EGR system having the LP EGR valve 28, a throttle system having the throttle valve 56, the variable geometry turbocharger, and so forth) of the engine system 10 to achieve the system control variable set points. Although not required, the component control variable set points 114 may be determined based, at least in part, on the control variable set points for the engine system and/or the coordinated system control variable set points and a selected mode of engine operation. In some cases, the supervisory controller 106 may be a model predictive controller (MPC) utilizing model predictive control technique; but this is not required.

The supervisory controller 106 may be configured to receive system control variable set points 110. Example system control variable set points 110 may include, but are not limited to, set points for air mass flow rate, oxygen concentration at the intake manifold 30, oxygen concentration at an inlet of the compressor, pressure difference across the throttle valve 56, and/or other suitable system control variable set points. In some cases, the supervisory controller 106 may receive feedback from sensors 14 of the engine 12 and from virtual sensors 116 determining values based on feedback from the sensors 14. Additionally, in some cases, the system control variable set points 110 may receive, or otherwise take into account during calculations, preview information 109 received at the controller 18 over a wireless (or wired) connection 111. The preview information received at the supervisory controller 106 may relate to disturbance variables affecting operation of the engine system 10 that may include, but is not limited to, information from the cruise control system, aftertreatment system, navigation maps (e.g., road grade information, road curvature information, traffic flow on a horizon, speed limits, traffic lights, lead vehicle positioning), and/or other suitable preview information, which may include actual values and/or preview values based on the predicted horizon. The supervisor controller 106 may utilize outputs (e.g., signals) from the sensors 14, outputs from the virtual sensors 116, and/or received preview information 109 to determine parameter values for the operating engine.

In some cases, the supervisory controller 106 may utilize feedback from the sensors 14, 116 and/or the preview information related to disturbance variables to transform or modify the received system control variable set points 110 into the engine system 10 coordinated system control variable set points 112 based on a model of the engine system 10, so as to adjust for current operating conditions of the engine system 10. The development of the coordinated system control variable set points may reduce tracking errors caused by component level set point calculation or by the component controllers 108. Utilization of the additional preview information related to disturbance variables when developing the coordinated system control variable set points may facilitate optimizing operation of the engine system 10 (e.g., optimizing fuel consumption, emissions (e.g., NOx and PM), health states of components (e.g., a health of a battery), and so on).

As discussed, the supervisory controller 106 may determine component control variable set points 114 for the components of the engine system 10 based on the model of the engine system 10, the coordinated system control variable set points 112, the preview information 109, and/or feedback from the sensors 14, 116. Example component control variable set points 114 may include, but are not limited to HP EGR flow rate, LP EGR flow rate, turbine power (e.g., turbocharger energy), pressure difference at the throttle valve 56, and/or other suitable component control variable set points 114. The model of the engine system 10 may take into account the ideal gas law, mass conservation law, and energy balance law with respect to the engine system 10.

The supervisory controller 106, in some cases, may take that form of an MPC. In such instances, the supervisory controller 106 may utilize the following cost function to determine the component control variable set points 114:

$$J = \sum_{i=1}^{N_p} (y_{sp} - y)^T Q (y_{sp} - y) + \sum_{i=1}^{N_p} \Delta u^T R \Delta u + \sum_{i=1}^{N_p} (y_{sp} - u)^T S (y_{sp} - u) \quad (1)$$

$$\text{s.t.: } \underline{\Delta u_k} \le \Delta u_k \le \overline{\Delta u_k}$$

where, "y" is the system output and the subscript, "SP" represents the system output set point 110, u is the coordinated system control variable 112, corresponding to the supervisor computed setpoints. "$N_p$" represents the prediction horizon steps, and "Q", "R", "S" are weighting matrices.

The one or more component controllers 108 may be configured to control operation of (e.g., actuators of) the one or more components of the engine system 10 to achieve the control variable set points for the one or more components by setting manipulated variable set points for the one or more components based, at least in part, on the component control variable set points 114, parameter values determined based, at least in part, on signals from the sensors 14, 116, and/or a model based on non-linear dynamic inversion. As depicted in FIG. 3, the component controllers 108 may output manipulated variable set points (e.g., actuator set points) for the components of the engine 12. In some cases, the one or more component controllers may be or may utilize a non-linear compensator.

Each of the non-linear compensators may include a model of an associated engine component (e.g., a single model for a single engine component) that is based on non-linear dynamic inversion. In some cases, the non-linear compensator may be configured to output manipulated variable set points for a component of the one or more components of the engine system 10 using the model for the component and based on a component control variable set point for the component and a selected engine mode of the plurality of coordinated engine modes of operation.

Figure 4:
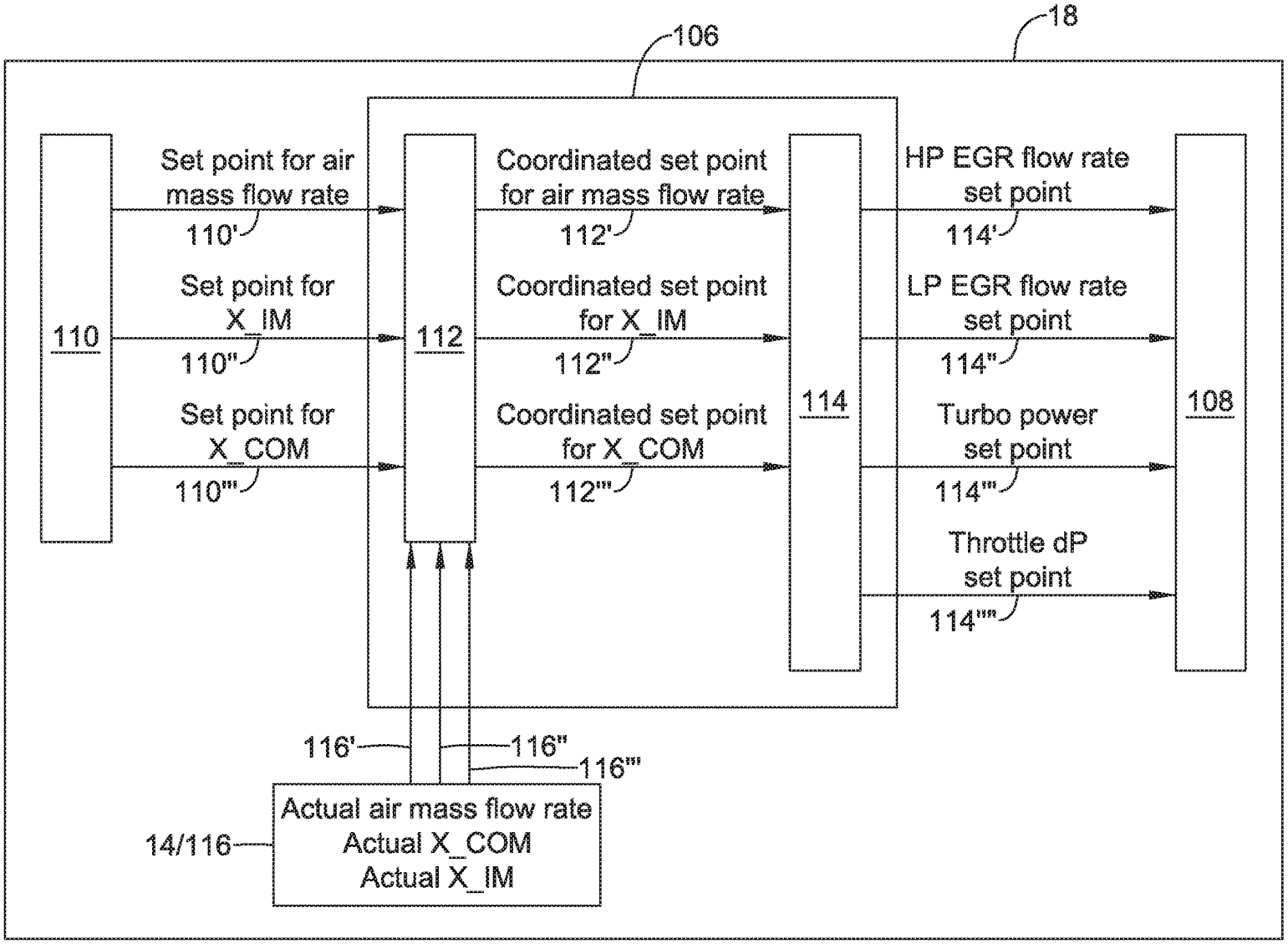
FIG. 4 is a schematic diagram of an illustrative controller flow for an air path of an engine system.

FIG. 4 depicts an example flow of information through the controller 18 of the engine system 10 having components including, but not limited to, a throttle valve, an LP EGR, an HP EGER, and a turbo. In the example depicted in FIG. 4, the system control variable set points 110 including, but not limited to, a set point for air mass flow rate 110', a set point for oxygen concentration (X_IM) at the intake manifold 110" (e.g., the intake manifold 30), and a set point for oxygen concentration 110'" (X_COM) at an inlet of the compressor (e.g., the compressor 50) may be provided to the supervisory controller 106. Additionally, the supervisory controller 106 may receive sensor outputs from the sensors 14 and/or the virtual sensors 116, which may include, but may not be limited to, an actual air mass flow rate 116', an actual oxygen concentration (X_IM) at the intake manifold 116", and an actual oxygen concentration X_COM) at the compressor 116'". The supervisory controller 106 may determine coordinated system control variable set points 112 based on the received system control variable set points 110, the received sensor outputs, and/or preview information. The determined coordinated system control variable set points 112 may include, but are not limited to, a coordinated set point for air mass flow rate 112', a coordinated set point for oxygen concentration at the inlet of the intake manifold 112", and a coordinated set point for oxygen concentration at the compressor 112'", and the supervisory controller 106 may use these coordinated set points 112 to determine one or more component control variable set points 114. The determined component control variable set points 114 may include, but are not limited to, an HP EGR flow rate set point 114', an LP EGR flow rate set point 114", a turbo power set point 114'", and a throttle differential pressure (dp) set point 114'", and the supervisory controller 106 may output these component control variable set points 114 to the respective component controllers 108 associated with the LP EGR, HP EGR, turbocharger, and throttle valve.

Illustratively, FIG. 4 is a schematic diagram that depicts the concept of non-linear compensation. In operation, a non-linear compensator may derive a component actuator position (e.g., a manipulated variable set point) through one or more sensitivity calculations based, at least in part, on component control variable set points 114 and feedback information from the sensors 14, 116 of the engine system 10.

Figure 5:
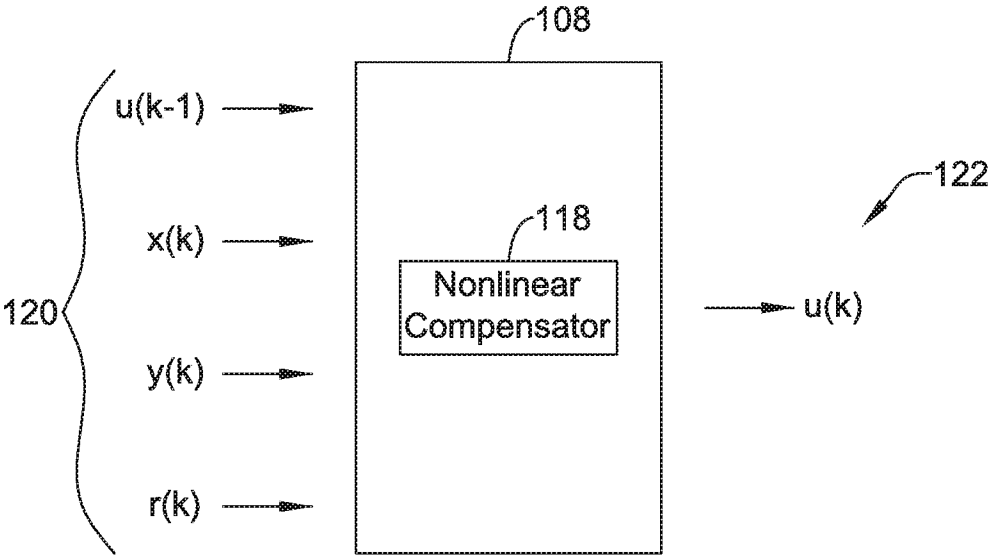
FIG. 5 is a schematic diagram of an illustrative non-linear compensator of a component controller.

FIG. 5 depicts a flow of information utilized by a non-linear compensator 118 of a component controller 108. In the example of FIG. 5, a plurality of inputs 120 are inputted into the non-linear compensator 118 and an output 122 of the non-linear compensator 118 may provide a set point for a component actuator, u(k), (e.g., a manipulated variable set point for a component of the engine 12). In some cases, the inputs 120 to the non-linear compensator 118 may include, but are not limited to, a component control variable set point (e.g., r(k)), a current output of the component (e.g., y(k)), a current state of the component (e.g., x(k)), and a previous manipulated variable set point (e.g., a previous actuator position, u(k−1)).

Dynamics for the non-linear compensator 118 may be described by:

$$\dot{x}=f(x,u)$$

$$y=h(x,u) \tag{2}$$

where, "x" may represent the state of the pertinent engine component, "u" may represent an engine component input, "y" may represent an engine component output, and "f" and "h" may be non-linear functions. The "over-dot", as used throughout this application, may refer to a derivative in time. The dynamic inverse concept may be given by:

$$\dot{e}+K_c e=0 \tag{3}$$

where, "e" may be a tracking error and "$K_c$" may be a tunable parameter that affects how quickly an error is reduced. The dynamic of the tracking error may be prescribed to behave as a stable dynamic system with a time constant given by this calibration parameter. The error and its derivatives may be defined by:

$$e=(r-y)=(r-h(x,u)) \tag{4}$$

$$\dot{e}=(\dot{r}-\dot{y})=\left(\dot{r}-\frac{\partial h(x,u)}{dx}\dot{x}-\frac{\partial h(x,u)}{du}\dot{u}\right)$$

where, "r" may be the component set point. Substituting equation (4) in equation (3) may provide:

$$\dot{u}=\left(\frac{\partial h(x,u)}{du}\right)^{-1}\left(\dot{r}-\frac{\partial h(x,u)}{dx}\dot{x}+K_c(r-h(x,u))\right) \tag{5}$$

A discrete time equivalent of equation (6) may be a sample time of 10 milliseconds (ms) and/or one or more other suitable sample times. A computationally efficient approach to computing the Jacobian terms may be to use virtual sensors (e.g., the virtual sensors 116) based on rational polynomial models for the parameters to be outputted from the virtual sensors.

In some cases, one or more component models may be needed to estimate all of the unmeasured states of the engine system 10 (e.g., the unmeasured states of the air-path system of the engine 12). In some cases, a virtual sensor based model may be developed for specific states of the engine components that may be difficult to measure with physical sensors. For example, while oxygen concentration of an air intake route may be measurable with a gas analyzer or with a lambda sensor, its measurement may be difficult or not possible in an actual production engine due to costs and lack of endurance of the physical sensor. EGR flow rates may also be difficult to measure directly. As a result, virtual sensor models may be useful in combination with available physical sensors.

In some cases, the non-linear compensator 118 may utilize a virtual sensor based component model. In one example, a component model of HP EGR flowrate may be:

$$m_{HP\ EGR}=f_1(p_1,p_2,T_{HP\ EGR},A_{HP\ EGR}) \tag{6}$$

The HP EGR flowrate, "m", may be the function of states (x) and actuator position (u) of the component, as in equation (2) above. In equation (6), the states (x) of HP EGR flowrate may be turbine inlet pressure, $p_3$, inlet manifold pressure, $p_2$, and gas temperature, $T_{HPEGR}$. The output of the non-linear compensator 118 may be the required flow area of the HP EGR valve, $A_{HPEGR}$. Using the HP EGR flowrate component model of equation (6), assuming the component control variable set point for the HP EGR component is available, the change in valve area, u-dot ($\dot{u}$), may be determined via the non-linear compensator using equation (5). The HP EGR valve area outputted from the non-linear compensator may be mapped to a corresponding HP EGR valve via a static characteristic curve.

Figure 6:
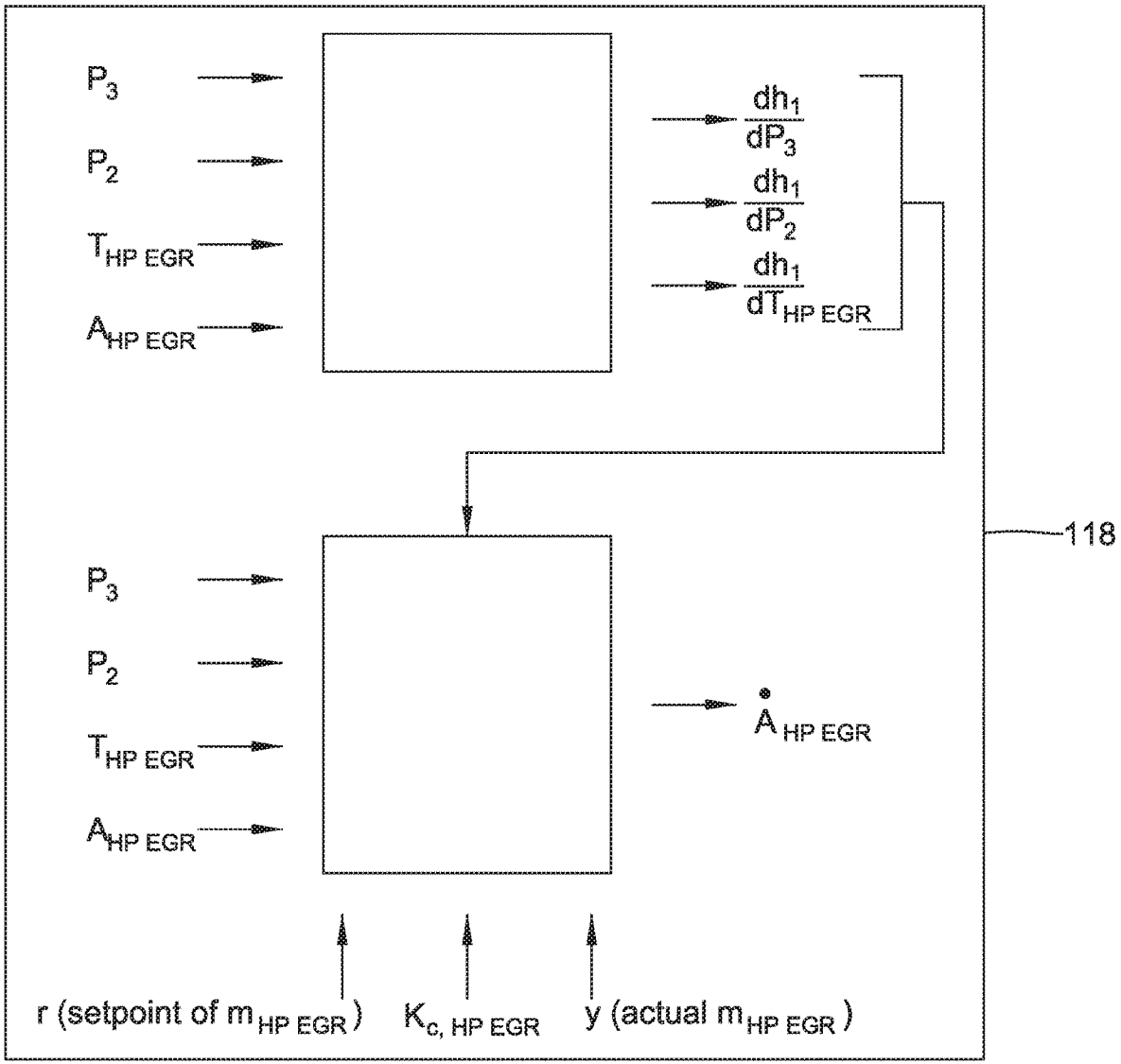
FIG. 6 is a schematic diagram of an illustrative non-linear compensator for a high pressure exhaust gas recirculation (HP EGR) valve component controller.

FIG. 6 depicts a computational flow of the non-linear compensator 118 utilizing a model based non-linear dynamic inversion and configured for an HP EGR component and to output a change rate of effective flow area of the HP EGR valve. Similar to as discussed above with respect to equation (6), "$A_{HP\ EGR}$" may be the effective flow area of the HP EGR valve, "$p_3$" may be the turbine inlet pressure, "$p_2$" may be the inlet manifold pressure, "$T_{HPEGR}$" may be the HP EGR inlet gas temperature. Further, "r" may be a control variable set point of HP EGR flow rate, "y" may be an actual HP EGR flow rate, and "$K_c$" may be a tunable parameter utilized to adjust a control loop time and may be determined for each component via dynamic engine tests. "$p_2$" values may be obtained from physical sensors and "$p_3$" and "$T_{HPEGR}$" values may be obtained from respective virtual sensors, but this is not required. The developed models may be constructed in polynomial form to facilitate efficient application in the controller 18.

As shown in FIG. 6, the effective flow area of the HP EGR valve, $A_{HPEGR}$ the turbine inlet pressure, $p_3$, the inlet manifold pressure, $p_2$, and the HP EGR inlet gas temperature, $T_{HP\ EGR}$, may be inputs and a change in the turbine inlet pressure, $dh_1/dp_3$, a change in the inlet manifold pressure, $dh_1/dp_2$, and a change in the HP EGR inlet gas temperature, $dh_1/dT_{HP\ EGR}$, may be calculated based on these inputs. The changes in the turbine inlet pressure, $dh_1/dp_3$, the inlet manifold pressure, $dh_1/dp_2$, and the HP EGR inlet gas temperature, $dh_1/dT_{HP\ EGR}$, along with values of the turbine inlet pressure, $p_3$, the inlet manifold pressure, $p_2$, and the HP EGR inlet gas temperature, $T_{HP\ EGR}$, the control variable set point of HP EGR flow rate, r, the actual HP EGR flow rate, y, and the tunable parameter, IQ, may be utilized to determine a change of rate of effective flow area of the HP EGR valve, $A_{HPEGR}$. As discussed above, the effective flow area of the HP EGR valve may be utilized to determine a set point for the HP EGR valve.

Non-linear compensators may be derived, developed, and/or configured in a similar manner for other engine components (e.g., the LP EGR component, turbine component, throttle valve component, and so forth). For example, non-linear compensators may be derived for other components based, at least in part, on a relevant component model and control variable set points for the component (e.g., LP EGR flow rate, turbine power, delta pressure across the air throttle valve, and so on).

A non-linear compensator for an LP EGR component may be based on the following model:

$$m_{LP\ EGR}=f_2(p_6,p_1,T_{LP\ EGR},A_{LP\ EGR}) \quad (7)$$

where, LP EGR mass flow rate, $m_{LP\ EGR}$, may be a function of inlet pressure, $p_6$, at the entry of the LP EGR system, outlet pressure, $p_1$, at a LP EGR system, gas temperature at the LP EGR valve, $T_{LP\ EGR}$, and actuator effective area of the LP EGR valve, $A_{LP\ EGR}$.

A non-linear compensator for a turbocharger component may be based on a component model developed in the form of power. The turbocharger may be one of the energy recovery components through the expansion of hot exhaust gas in a turbine. This recovered energy may be used to compress incoming gas by the compressor. In a variable geometry turbocharger, the recoverable energy may be adjusted by adjusting one or more vanes of the turbocharger, which in turn, may affect the turbine inlet pressure, $p_3$. The power available at any condition may be dependent on states associated with the turbocharger including, but not limited to, turbine outlet pressure, $p_4$, turbine inlet temperature, $T_3$, and mass flow rate of turbine, mt. The turbine power. $P_t$ may be expressed as:

$$P_t=f_3(p_3,p_4,T_3,m_t) \quad (8)$$

Using this component model of turbine power, the non-linear compensator for the turbocharger may determine a required inlet pressure to provide enough power to achieve the control variable set point for compressor mass flow rate, which may be transferred into turbine power through energy efficiency in the compressor and turbine. The demanded turbine inlet pressure may be subsequently mapped to an associated vane position using a polynomial based on the turbine map to output the manipulated variable set point (e.g., vane position set point).

A non-linear compensator for a throttle valve component may be based on a component model developed in the form of a difference in pressure across an air throttle valve. In some cases, the difference in pressure across the air throttle valve may be modeled as a function of a gas mass flow rate across the throttle valve, $m_{thr}$, a gas density at the throttle valve, $\rho_{thr}$, and effective area of the air throttle valve, $A_{thr}$. The difference in pressure across the air throttle valve may be expressed as:

$$\Delta p_{thr}=f_4(m_{thr},\rho_{thr},A_{thr}) \quad (9)$$

As with the HP EGR case, this flow area may be converted into the valve position command of the air throttle valve via an identified characteristic area curve.

Figure 7:
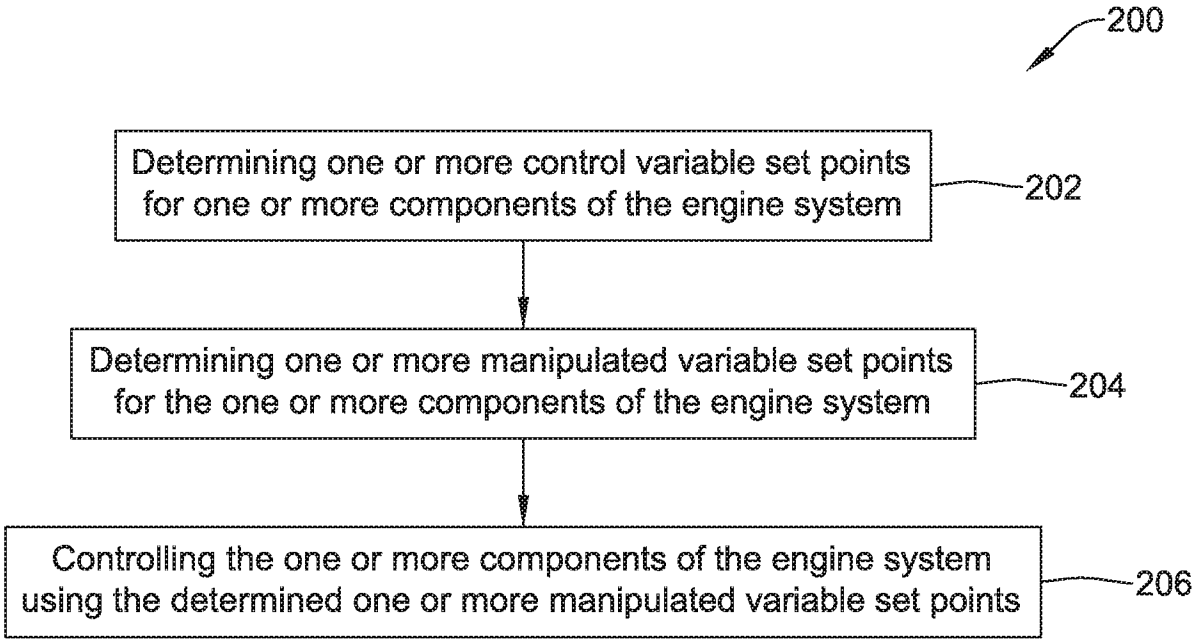
FIG. 7 is a schematic diagram of an illustrative method of controlling components of an engine system.

FIG. 7 depicts an illustrative method 200 of controlling operation of an engine system. In some cases, the method may be configured to control the operation of an engine system comprising a diesel engine and one or more components configured to adjust operation of the diesel engine.

The method 200 may include determining 202 one or more control variable set points for one or more components of the engine (e.g., the engine 12 and/or one or more other suitable engines). The control variable set points for one or more components of the engine may be determined in any suitable manner, for example, including, but not limited to, as discussed herein. In one example, a supervisory controller (e.g., the supervisory controller 106 and/or one or more other suitable supervisory controllers) may be configured to determine control variable set points for one or more components of an engine system (e.g., the engine system 10 and/or one or more other suitable engine systems) based on control variable set points for the engine system. Example control variable set points for the engine system may include, but are not limited to, a value of an air mass flow rate, a value of an oxygen concentration at the intake manifold, a value of an oxygen concentration at a compressor, a value of a pressure difference across an air throttle valve, and so on. Example control variable set points for engine components include, but are not limited to, HP EGR flow rate, LP EGR flow rate, turbine power, pressure difference at an air throttle valve, and so on.

The method 200 may further include determining 204 one or more manipulated variable set points for the one or more components of the engine system. The manipulated variable set points for the one or more components of the engine may be determined by any suitable manner, for example including, but not limited to, as discussed herein. In one example, a component controller (e.g., the component controller 108 and/or one or more other suitable component controllers) or a non-linear compensator (e.g., the non-linear compensator 118 and/or one or more other suitable non-linear compensators) may be configured to determine manipulated variable set points for the one or more components based on the control variable set points for the one or more components and a model based on non-linear dynamic inversion. Example manipulated variables include, but are not limited to, throttle valve position, HP EGR valve position, LP EGR valve position, VGT or WG position, and so forth.

Further, the method 200 may include controlling 206 one or more components of the engine system to achieve the control variable set points for the engine system. The controlling 206 of the one or more components may be based on the determined manipulated variable set points to achieve the control variable set points for the engine system. In operation, the component controllers (e.g., the component controllers 108 and/or other suitable controllers) may output actuator control signals to the engine components to control the actuators according to the determined manipulated variable set points. In one example, the control signals may include an actuator position associated in a map with a determined manipulated variable set point.

A recap in view of FIGS. 1-7 may be noted. An illustrative engine system may include a diesel engine, one or more components, and a system controller. The one or more components may be controllable to adjust operation of the diesel engine. The system controller may be connected to the diesel engine and the one or more components. In some cases, the system controller may include a supervisory controller configured to receive system control variable set points and coordinate component control variable set points for the one or more components to achieve the system control variable set points. Further, the system controller may include one or more component controllers configured to control operation of the one or more components to achieve the control variable set points for the one or more components by setting manipulated variable set points for the one or more components based on the component control variable set points and a model based non-linear dynamic inversion.

An engine system may further include one or more sensors in communication with the diesel engine and the system controller. The one or more sensors may be configured to sense one or more engine parameters of the diesel engine and provide signals to the system controller based on the one or more engine parameters sensed.

In some cases, an engine system may include one or more sensors in communication with at least one of the one or more components and the system controller. The one or more sensors may be configured to sense one or more component parameters and provide signals to the system controller based on the one or more component parameters sensed.

One or more components of the engine system may include one or more components selected from a group consisting of a low pressure exhaust gas recirculation (LP EGR) component, a high pressure exhaust gas recirculation (HP EGR) component, throttle valve, exhaust flap, intake throttle, electric-turbocharger, variable-geometry turbocharger (VGT), and wastegate turbocharger.

In some cases, one or more component control variables for the component control variable set points may be selected from a group consisting of a low pressure exhaust gas recirculation (LP EGR) flow rate, a high pressure exhaust gas recirculation (HP EGR) flow rate, a delta pressure across a throttle valve, and turbocharger power.

One or more component manipulated variables for the component manipulated variable set points may be selected from a group consisting of a low pressure exhaust gas recirculation (LP EGR) valve position, a high pressure exhaust gas recirculation (HP EGR) valve position, electric-turbocharger power input, variable-geometry turbocharger (VGT) valve position, and wastegate (WG) actuator position.

In some cases, the supervisory controller may be based on model predictive control (MPC).

In some cases, at least one of the one or more component controllers may be configured to control operation of the one or more components to achieve the control variable set points for the one or more components by setting manipulated variable set points for the one or more components based on the component control variable set points and a multivariable model based non-linear dynamic inversion.

A diesel engine and one or more components of the engine system may be configured to operate in a plurality of coordinated engine-modes. The model of the system controller may be based non-linear dynamic inversion and may include a single model that outputs a manipulated variable set point for a component of the one or more components based on a component control variable set point for the component and a selected engine-mode of the plurality of coordinated engine-modes.

The disclosure may include a method of controlling operation of an engine system including a diesel engine and one or more components configured to adjust operation of the diesel engine. The method may include determining, at a supervisory controller, control variable set points for the one or more components of the engine system based on control variable set points for the engine system determining, at a non-linear compensator, manipulated variable set points for the one or more components based on the control variable set points for the one or more components and a model based non-linear dynamic inversion, and controlling the one or more components based on the manipulated variable set points to achieve the control variable set points for the engine system.

In the method, the engine system may be configured to operate in a plurality of coordinated engine-modes, and the model based non-linear dynamic inversion includes a single model configured to output a manipulated variable set point for a component of the one or more components based on a component control variable set point for the component and a selected engine-mode of the plurality of coordinated modes.

In some cases, determining the control variable set points for the one or more components of the engine system may be based on the control variable set points for the engine system and the selected engine-mode.

The method may further include determining parameter values based on signals from sensors sensing parameters of one or more of the diesel engine and the one or more components. The determining the manipulated variable set points for the one or more components may be based on the parameter values determined.

The method may further include receiving preview information related to a predicted travel horizon at the supervisory controller and determining parameter values based on signals from sensors sensing parameters of one or more of the diesel engine and the one or more components. In some cases, the determining the control variable set points for the one or more components may be based on preview information received and the parameter values determined.

This disclosure may include a computer readable medium having stored thereon in a non-transitory state a program code for use by a computing device. The program code may cause the computing device to execute a method for controlling operation of an engine system including a diesel engine and one or more components configured to adjust operation of the diesel engine. The method may include determining, at a supervisory controller, control variable set points for the one or more components of the engine system based on control variable set points for the engine system, determining, at a non-linear compensator, manipulated variable set points for the one or more components based on the control variable set points for the one or more components and a model based non-linear dynamic inversion, and controlling the one or more components based on the manipulated variable set points to achieve the control variable set points for the engine system.

In some cases, engine system with which the method is used may be configured to operate in a plurality of coordinated engine-modes. The model based non-linear dynamic inversion may include a single model configured to output a manipulated variable set point for a component of the one or more components based on a component control variable set point for the component and a selected mode of the plurality of coordinated modes.

In the method, determining the control variable set points for the one or more components of the engine system may be based on the control variable set points for the engine system and the selected engine-mode.

The method for controlling operation of an engine system may further include determining parameter values based on signals sensors sensing parameters of one or both of the diesel engine and the one or more components. The determining the manipulated variable set points for the one or more components may be based on the parameter values determined.

The method for controlling operation of an engine system may further include determining parameter values based on signals sensors sensing parameters of one or both of the diesel engine and the one or more components. The determining the control variable set points for the one or more components is based on the parameter values determined.

In some cases, the supervisory controller used with the method may be based on model predictive control (MPC).

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. An engine system comprising:

a diesel engine;

a plurality of components controllable to adjust operation of the diesel engine; and a system controller connected to the diesel engine and the plurality of components controllable to adjust operation of the diesel engine;

wherein:

the system controller includes a supervisory controller, the supervisory controller comprises inputs configured to receive system control variable set points and is further configured to coordinate component control variable set points for at least one of the plurality of components to achieve the system control variable set points by further including one or more non-linear compensators configured to control operation of at least one of the plurality of components to achieve the control variable set points for at least one of the plurality of components by setting manipulated variable set points for at least one of the plurality of components based on the component control variable set points, and to output the manipulated variable set points to the at least one of the plurality of components;

wherein the one or more non-linear compensators are each based on a subsystem-specific implementation of a model based non-linear dynamic inversion control approach.

2. The engine system of claim 1, further comprising:

one or more sensors in communication with the diesel engine and the system controller; and wherein the one or more sensors are configured to sense one or more engine parameters of the diesel engine and provide signals to the system controller based on the one or more engine parameters sensed.

3. The engine system of claim 1, further comprising:

one or more sensors in communication with at least one of the plurality of components and the system controller; and wherein the one or more sensors are configured to sense one or more component parameters and provide signals to the system controller based on the one or more component parameters sensed.

4. The engine system of claim 1, wherein the plurality of components includes a high pressure exhaust gas recirculation (HP EGR) valve, and the one or more non-linear compensators include a non-linear compensator configured to control the HP EGR valve.

5. The engine system of claim 1, wherein the plurality of components includes at least a high pressure exhaust gas recirculation (HP EGR) valve, a throttle valve, and a turbocharger, and the one or more component control variables for the component control variable set points include, a high pressure exhaust gas recirculation (HP EGR) flow rate, a delta pressure across a throttle valve, and turbocharger power.

6. The engine system of claim 1, wherein the plurality of components includes a low pressure exhaust gas recirculation (LP EGR) valve, and the one or more component manipulated variables for the component manipulated variable set points include a LP EGR valve position.

7. The engine system of claim 1, wherein the supervisory controller is based on model predictive control (MPC).

8. The engine system of claim 1, wherein at least one of the one or more non-linear compensators is configured to control operation of the at least one of the plurality of components to achieve the control variable set points for the at least one of the plurality of components by setting manipulated variable set points for the at least one of the plurality of components based on the component control variable set points and a model based non-linear dynamic inversion approach.

9. The engine system of claim 1, wherein:

the diesel engine and the plurality of components are configured to operate in a plurality of coordinated engine-modes; and the model based non-linear dynamic inversion includes a single model that outputs a manipulated variable set point for a component of the plurality of components based on a component control variable set point for the component and a selected engine-mode of the plurality of coordinated engine-modes.

10. A method of controlling operation of an engine system including a diesel engine and a plurality of components configured to adjust operation of the diesel engine, the method comprising:

determining, at a supervisory controller, control variable set points for the one or more components of the engine system based on control variable set points for the engine system, the engine system comprising the supervisory controller and one or more non-linear compensators, wherein the non-linear compensators are coupled to at least one of the plurality of components to control operation thereof;

determining, at a non-linear compensator, manipulated variable set points for the at least one of the plurality of components based on the control variable set points for the at least one of the plurality of components by the use of a subsystem-specific implementation of a model based non-linear dynamic inversion control approach; and generating control signals from the non-linear compensator to the at least one of the plurality of components based on the manipulated variable set points to achieve the control variable set points for the engine system.

11. The method of claim 10, wherein:

the method includes operating the engine system in a plurality of coordinated engine-modes; and the step of generating control signals from the non-linear compensator includes outputting a manipulated variable set point for the at least one of the plurality of components based on a component control variable set point for the component and a selected engine-mode of the plurality of coordinated modes.

12. The method of claim 11, wherein determining the control variable set points for the at least one of the plurality of components of the engine system is based on the control variable set points for the engine system and the selected engine-mode.

13. The method of claim 10, wherein the supervisory controller is coupled to a plurality of sensors configured to sense parameters of the engine system and one or more components, further comprising:

determining parameter values based on signals from the plurality of sensors;

wherein the step of determining the manipulated variable set points for the at least one of the plurality of components is based on the parameter values determined.

14. The method of claim 10, wherein the supervisory controller is coupled to a plurality of sensors configured to sense parameters of the engine system and one or more components, further comprising:

receiving preview information related to a predicted travel horizon at the supervisory controller;

determining parameter values based on signals from the plurality of sensors; and wherein the determining the control variable set points for the at least one of the plurality of components is based on preview information received and the determined parameter values.

15. A computer readable medium having stored thereon in a non-transitory state a program code for use by a computing device, the program code causing the computing device to execute a method for controlling operation of an engine system including a diesel engine, a plurality of components configured to adjust operation of the diesel engine, and a plurality of sensors configured to sense parameters of the diesel engine and the plurality of components, the method comprising:

determining, at a supervisory controller, control variable set points for the plurality of components of the engine system based on control variable set points for the engine system;

determining, at a non-linear compensator, manipulated variable set points for at least one of the plurality of the components based on the control variable set points for the at least one of the plurality of components and a subsystem specific implementation of more a model based non-linear dynamic inversion control approach; and controlling the at least one of the plurality of components based on the manipulated variable set points to achieve the control variable set points for the engine system.

16. The computer readable medium of claim 15, wherein:

the engine system is configured to operate in a plurality of coordinated engine-modes; and the model based non-linear dynamic inversion includes a single model configured to output a manipulated variable set point for the at least one of the plurality of components based on a component control variable set point for the component and a selected mode of the plurality of coordinated modes.

17. The computer readable medium of claim 16, wherein determining the control variable set points for the plurality of components of the engine system is based on the control variable set points for the engine system and the selected engine-mode.

18. The computer readable medium of claim 15, the method for controlling operation of an engine system further comprises:

determining parameter values based on signals from the plurality of sensors; and wherein the determining the manipulated variable set points for the at least one of the plurality of components is based on the determined parameter values.

19. The computer readable medium of claim 15, the method for controlling operation of an engine system further comprises:

determining parameter values based on signals from the plurality of sensors; and wherein the determining the control variable set points for the plurality of components is based on the determined parameter values.

20. The computer readable medium of claim 15, wherein the supervisory controller is based on model predictive control (MPC).

* * * * *